United States Patent [19]

Giuseppe

[11] Patent Number: 4,553,488

[45] Date of Patent: Nov. 19, 1985

[54] PROCEDURE AND FURNACE TO INCINERATE WASTE MATERIALS WITHOUT PRODUCING SMOKE

[76] Inventor: Carrara Giuseppe, Via Cavour, 125, Cernusco sul Naviglio, Italy

[21] Appl. No.: 687,266

[22] Filed: Dec. 28, 1984

[30] Foreign Application Priority Data

Jan. 12, 1984 [IT] Italy ..... 19138 A/84

[51] Int. Cl.[4] ..... F23G 3/00; F23G 5/00; F23G 7/00

[52] U.S. Cl. ..... 110/346; 110/236

[58] Field of Search ..... 110/235, 236, 346, 242, 110/248

[56] References Cited

U.S. PATENT DOCUMENTS

| | | | |
|---|---|---|---|
| 4,141,373 | 2/1979 | Kartanson et al. | 110/236 X |
| 4,181,081 | 1/1980 | Weber | 110/236 X |
| 4,253,406 | 3/1981 | Spitz et al. | 110/242 X |
| 4,287,079 | 9/1981 | Swistun | 110/242 X |
| 4,495,873 | 1/1985 | Blankenship | 110/242 X |
| 4,515,091 | 5/1985 | Schlueter | 110/236 X |

*Primary Examiner*—Edward G. Favors

[57] ABSTRACT

Procedure to obtain incineration of waste material without producing smoke; it consists in causing carbonization, distillation and combustion of the material to be destroyed by the effect of the heat transferred to it by a pre-heated red hot steel plate apt to move in top to bottom direction by the force of gravity; the furnace implementing the procedure comprises a truncated cylinder shaped hollow steel body, the bottom part of which is provided with a hearth surmounted by a circular plate heated red hot and sustained by an axially slidable tubular element.

5 Claims, 2 Drawing Figures

PROCEDURE AND FURNACE TO INCINERATE WASTE MATERIALS WITHOUT PRODUCING SMOKE

BACKGROUND OF THE INVENTION

This invention relates to a procedure and furnace apt to incinerate waste materials, for example, artificial plastic material, without giving rise to the creation of smoke.

Although the procedure and special furnace may have unlimited applications insofar as the materials to be incinerated are concerned, they are particularly advantageous and suited to destroy, by incineration, photographic and cinematographic film residuates resulting from the electrochemical treatments performed on same, in order to recover the metals (mainly precious metals) used for the sensitive emulsions previously deposited on said films.

The main advantages that can be obtained by implementation of the procedure and furnace according to the invention as compared to other means for the destruction of waste material already known in the art, consist in a greater simplicity, lower operating costs, and, while consenting the desired results, do not require burners and purifiers for the smoke produced, unlike the known equipment.

The procedure forming the object of this invention consists essentially in producing the carbonization, distillation and combustion of a mass of waste material to be destroyed by the effect of the heat transferred to said mass by a steel preheated red hot plate which is caused to exert a downward pressure on the top surface of the waste mass itself; the heat which develops by the effect of combustion of the volatile substances as a result of the above distillation is utilized to maintain said large plate in the red hot condition until the material to be destroyed is totally exhausted.

The furnace required to implement the above described procedure is formed essentially by a truncated cylinder shaped hollow body preferably made of steel material, the bottom part of which is provided with a variable volume chamber which forms the hearth, whilst a steel plate, is placed over head, said plate being conveniently heated red hot and guided so as to move in a top to bottom direction; said plate is surmounted, at a given distance, by a second circular crown shaped plate; both plates are secured to each other and sustained by a tubular element, the end part of which terminates with at least one nozzle in the interspace between said plates, to inject air under pressure into said interspace.

The furnace required to implement the procedure for incineration of waste materials without producing smoke and which forms the object of this invention, will now be described in greater detail for a better understanding, in conjunction with the annexed drawing which illustrates, only by way of example, one preferred form of embodiment of the invention.

DESCRIPTION OF THE PREFERRED EMBODIMENT

Figure 1:
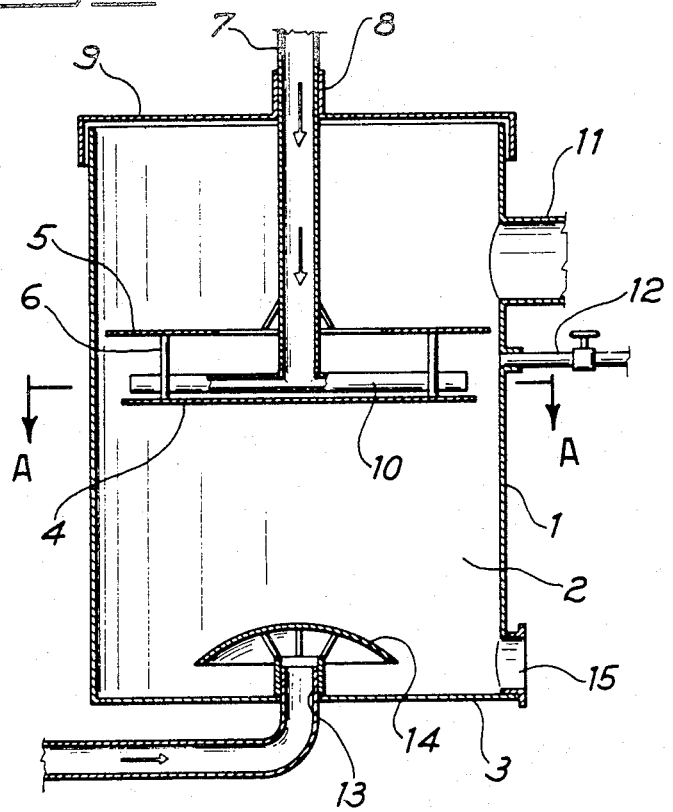
FIG. 1 is a horizontal view in longitudinal section of the furnace according to the invention.
Figure 2:
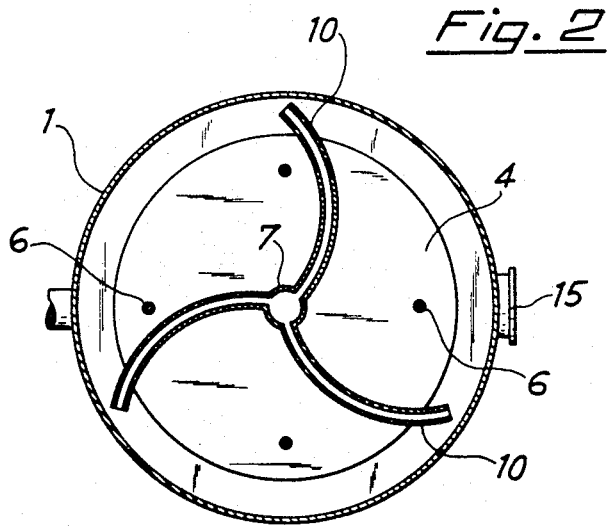
FIG. 2 is a view in cross-section of the furnace, taken on line A—A of FIG. 1.

The furnace for incineration of waste materials without producing smoke according to the above procedure is illustrated in annexed FIGS. 1 and 2.

The furnace consists of a hollow truncated cylindrical shaped steel body, the lower part of which is provided with a variable volume chamber 2 (constituting the hearth) the lower part of said chamber being limited by bottom 3 and its upper part by a large circular plate 4, also made of steel material and which is surmounted, at a certain distance, by a second steel plate 5 shaped as a circular crown and having a maximum diameter slightly smaller than the inside diameter of furnace 1.

Plates 4 and 5 are joined to each other by tie rods, for example 6 and both are sustained by a tubular element 7 apt to slide from top to bottom by gravity, conveniently guided in sleeve 8 secured to the covering element of the furnace; the lower end of said tubular element 7 terminates in the interspace between plates 4 and 5 with three curved nozzles 10, as it can be seen in annexed FIG. 2.

The furnace is completed by an aperture 11 to discharge the burnt gas and by an inlet nozzle 12 to introduce the gas needed to heat plate 4 to red heat.

An aperture 15 is provided near bottom 3 of the furnace and which may be opened or closed to discharge the ashes.

The furnace according to the invention is put into operation as follows;

(1) The waste material to be incinerated is loaded in the heart (i.e. the chamber delimited in its lower part by bottom 3 and in its top part by plate 4);

(2) Plate 4 is positioned above the waste material loaded;

(3) The plate is then heated red hot with a flame fed by a gaseous fuel introduced from the exterior through nozzle 12;

(4) The heating of plate 4 is interrupted, and the plate is moved downward until it comes in contact and exerts pressure on the material to be destroyed;

(5) The heat transferred by said plate 4 to the mass of waste material to be destroyed causes this material to be carbonized, distilled and ignited; in order to achieve and sustain the combustion and avoid the formation of smoke, air under pressure is introduced through tubular elements 7 and nozzles 10, causing the air jets to assume, preferably, a peripheral rotating direction.

As the process continues with consequent reduction of the volume of the material to be destroyed, the assembly consisting of red hot plate 4 shifts downward, pressing down upon and remaining constantly in contact with said mass of waste material.

In order to favour the combustion of the volatile substances released by the carbonized material, in addition to the air introduced via nozzles 10 located in the space between plates 4 and 5, an additional quantity of air can be caused to penetrate into the furnace through pipe stub 13 which passes through bottom 3 of the furnace and which is protected by a shielding element 14.

It is evident that the heat developed by the combustion of said volatile substances can be advantageously used for other purposes, besides maintaining plate 4 in the red hot condition.

What I claim is:

1. Procedure to incinerate waste materials without producing smoke, consisting in causing carbonization, distillation and combustion of a mass of waste material to be destroyed, characterized in that the carbonization and distillation of the material are achieved by the effect of the heat transferred to said mass by a steel plate pre-heated to red heat condition, said plate being caused to press down on the mass, and in that the complete combustion of the volatile substances derived from the distillation is achieved by introducing air under pressure; the heat which develops as a result of the combustion of said substances is utilized to maintain said plate heated in the red hot condition up to total exhaustion of the material to be incinerated.

2. Furnace to incinerate waste materials without producing smoke according to the procedure in above claim 1, comprising a vertical truncated cylinder shaped hollow body, the lower part of which is provided with a variable volume chamber which constitutes the hearth thereof; said furnace is characterized in that a metal plate forms the cover element of said chamber, said plate being surmounted at a certain distance by a second circular crown shaped plate joined to said first plate by tie rods and which may slide, with said first plate, parallel to itself, by gravity, from top to bottom direction; at least one nozzle to introduce the required combustion air outletting in the space between the first and second plate.

3. Furnace according to claim 2, characterized in that the first metal plate used as the cover element for variable volume chamber is circular shaped and has a diameter slightly smaller than the inside diameter of body of the furnace; said plate being designated to be heated to red hot condition to cause carbonization and distillation of the material to be incinerated as well as the combustion process of the volatile substances obtained by said distillation.

4. Furnace according to claim 2, characterized in that metal plate used as the cover element for variable volume chamber is made of steel material.

5. Furnace according to claim 2, characterized in that metal plate, used as the cover element for variable volume chamber and the second plate joined to first plate by tie rods, are connected to a tubular element running axially from top to bottom and guided in sleeve in turn secured to furnace cover element, the lower end of said tubular element terminating in the interspace between said two plates, with at least one curved nozzle.

* * * * *